United States Patent [19]

Moerre

[11] 4,268,107

[45] May 19, 1981

[54] FUSE HOLDER

[75] Inventor: Manfred Moerre, Warren, N.J.

[73] Assignee: The Singer Company, Stamford, Conn.

[21] Appl. No.: 89,671

[22] Filed: Oct. 30, 1979

[51] Int. Cl.[3] ..... H01H 85/22

[52] U.S. Cl. ..... 339/147 R; 337/194; 337/211; 339/150 F

[58] Field of Search ..... 339/147, 252 F, 253 F, 339/258 F, 259 F, 150 F; 337/228, 229, 230, 237, 194, 195, 196, 208, 211, 213

[56] References Cited

U.S. PATENT DOCUMENTS

| | | | |
|---|---|---|---|
| 1,906,280 | 5/1933 | Pierce . | |
| 2,244,532 | 6/1941 | Fenske, Jr. et al. | 200/133 |
| 2,707,736 | 5/1955 | Hollins | 200/115.5 |
| 3,406,365 | 10/1968 | Lameyre | 337/208 |
| 3,732,516 | 5/1973 | Puetz | 337/194 |
| 3,813,626 | 5/1974 | Cetola et al. | 337/245 |
| 3,872,416 | 3/1975 | Kinasi | 337/201 |
| 4,107,639 | 8/1978 | Levy | 337/205 |
| 4,164,726 | 8/1979 | Weibe | 337/215 |

FOREIGN PATENT DOCUMENTS

| | | | |
|---|---|---|---|
| 2445234 | 4/1975 | Fed. Rep. of Germany | 337/208 |
| 1533428 | 7/1968 | France | 337/230 |
| 2332608 | 6/1977 | France | 337/228 |

*Primary Examiner*—John McQuade

*Attorney, Agent, or Firm*—David L. Davis; Robert E. Smith; Edward L. Bell

[57] ABSTRACT

A fuse holder for a cartridge type fuse is formed of a housing having a fuse transfer region and a fuse contact region in the interior space thereof. A fuse carrier is provided, which carrier is captured within the housing. The fuse carrier is movable between the fuse transfer region and the fuse contact region. A fuse is inserted or removed into the fuse carrier through a suitable opening provided within the fuse transfer region. Within the fuse contact region there are provided fuse contact members which engage the conductive ends of the fuse when the carrier moves the fuse into the fuse contact region.

10 Claims, 4 Drawing Figures

FUSE HOLDER

DESCRIPTION

BACKGROUND OF THE INVENTION

This invention relates to fuse holders and, more particularly, to fuse holders adapted to receive fuses of the cartridge type.

It is common practice to provide fuse protection for electrically powered appliances, and the like. A common type of fuse utilized for in-line protection is what is known as a cartridge type fuse, which is ordinarily a small cylindrical cartridge having a diameter on the order of one-quarter inch. Such cartridge fuses generally comprise an insulated tube closed at both ends by conductive end caps, having internally disposed therebetween a fuse bus connecting the end caps. The end caps are adapted to be conductively engaged by respective fuse clips connected to the ends of respective leads. In this manner the fuse closes the circuit between the respective fuse clips and upon removal thereof at least one of the fuse clips is usually energized, presenting a hazard of shock and injury to the installer. Thus, many different types of devices have been proposed in the prior art which are specifically adapted to provide a means for insulated manual grasping of the cartridge fuse without unnecessarily exposing the installer to shock hazard. However, these devices have not proven to be entirely satisfactory due to, for example, difficulty of use.

It is therefore an object of this invention to provide a fuse holder for a cartridge type fuse that eliminates the possibility of a shock hazard while the fuse is being inserted or removed.

It is another object of this invention to provide such a fuse holder which is easy to use.

It is a further object of this invention to provide such a fuse holder which is inexpensive to manufacture.

SUMMARY OF THE INVENTION

The foregoing and additional objects are attained in accordance with the principles of this invention by providing a cartridge fuse holder which includes a housing having two interior regions; a fuse transfer region and a fuse contact region. Captured within the housing is a fuse carrier which is movable between the fuse transfer region and the fuse contact region. The fuse is inserted into or removed from the fuse carrier only when the fuse carrier is in the fuse transfer region. The only live electrical contacts are in the fuse contact region and these contacts engage the conductive ends of the fuse when the carrier moves the fuse into the fuse contact region.

In accordance with an aspect of this invention the fuse carrier has a handle portion extending through a suitable opening in the housing and the handle has resilient portions extending beyond the perimeter of the opening to provide a locking action for the carrier when the carrier is in the fuse contact region.

In accordane with a further aspect of this invention, both the housing and the fuse carrier are each formed of two identical parts which are assembled in an inversely opposing manner.

BRIEF DESCRIPTION OF THE DRAWINGS

The foregoing will be more readily apparent upon reading the following description in conjunction with the drawings wherein.

DETAILED DESCRIPTION

Figure 3:
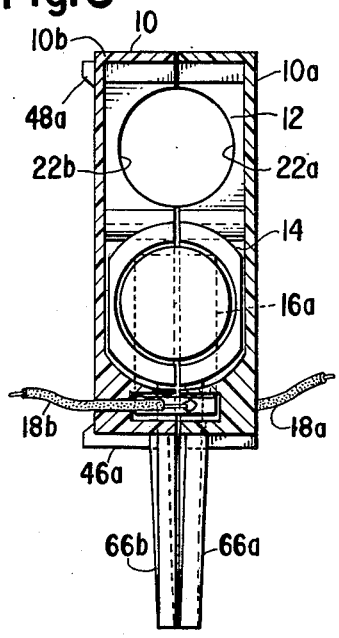
FIG. 3 is a cross sectional view taken along the line of 3—3 in FIG. 2 of the assembled fuse holder of FIG. 1.
Figure 2:
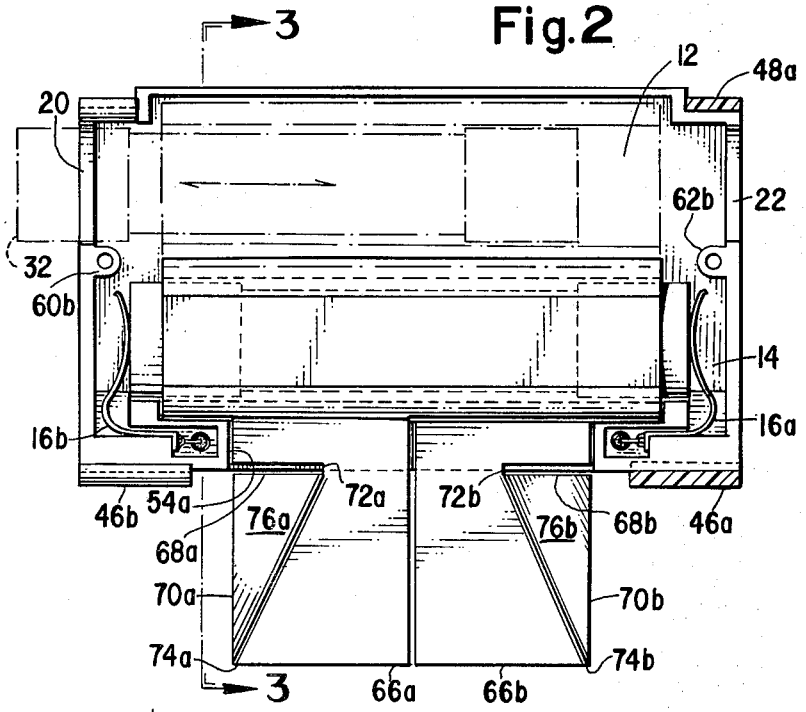
FIG. 2 is a top plan view, with the upper half of the housing removed, of the assembled fuse holder of FIG. 1.

Referring now to the drawings, wherein like elements in different figures thereof have the same reference character applied thereto, the fuse holder according to the present invention generally comprises a boxlike housing 10 preferably formed of two identical parts 10*a* 10*b*. The parts 10*a* and 10*b* are of insulative material and are preferably formed of a molded plastic material. The assembled housing 10 is divided into two enclosed regions; a fuse transfer region 12 and a fuse contact region 14. The fuse contact region 14 has fitted therein a pair of conductive fuse retaining members 16*a* and 16*b*, each connected to a respective wire 18*a* and 18*b*. Within the fuse transfer region 12 of the housing 10, there is provided a pair of openings 20 and 22. The openings 20 and 22 provide access for a fuse between the exterior of the housing 10 and the fuse transfer region 12 within the housing 10.

Captured within the housing 10 is a fuse carrying member 30, which preferably is formed of two identical parts 30*a* and 30*b*. Like the housing parts 10*a* and 10*b*, the parts 30*a* and 30*b* are of insulative material and are preferably formed of a molded plastic material. The fuse carrying member 30 is adapted to receive therein, in a manner to be described hereinafter, a cartridge type fuse 32 and to move the fuse 32 between the fuse transfer region 12 and the fuse contact region 14. The cartridge fuse 32 is generally cylindrical in shape and includes a pair of conductive metal end caps 34 and 36 as well as an insulative portion 38 intermediate the end caps 34 and 36.

For economy of manufacture and ease of assembly, it is preferable that the parts 10*a* and 10*b* of the housing 10 be identical, as shown in the drawings, and then assembled in an inversely opposed manner. Thus each of the parts 10*a* and 10*b* is of a generally flat open box-like configuration. To avoid confusion, identical portions of the parts 10*a* and 10*b* have the same reference numeral applied thereto but with the suffix "a" or "b", respectively.

Figure 4:
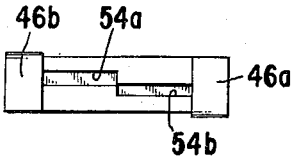
FIG. 4 is a front elevation view of the assembled fuse holder housing.

The parts 10*a* and 10*b* are formed with semi-circular openings 42*a* and 44*a*, and 42*b* and 44*b*, respectively, in opposite side walls thereof so that when the part 10*a* is inversely opposedly matched with the part 10*b*, the circular opening 20 is formed from the semi-circular openings 42*b* and 44*a* and the circular opening 22 is formed from the semi-circular openings 44*b* and 42*a*. To releasably secure the parts 10*a* and 10*b* together, the parts 10*a* and 10*b* are provided with respective pairs of resilient latching finger members 46*a* and 48*a*, and 46*b* and 48*b*. The latching finger member 46*b* is adapted to fit over the edge 50*a* of the part 10*a* and the latching finger member 48*b* is adapted to fit in the notched area 52*a* of the part 10*a*. Likewise, the latching finger member 46*a* is adapted to fit over the edge 50*b* of the part 10*b* and the latching finger member 48*a* is adapted to fit in the notched area 52*b* of the part 10*b*. To allow a handle portion of the fuse carrying member 30 to extend outwardly from the housing 10, the front walls of the parts 10*a* and 10*b* are provided with recesses 54*a* and 54*b*, respectively, which recesses 54*a* and 54*b* form a pair of openings when the parts 10*a* and 10*b* are assembled to form the housing 10, as clearly shown in FIG. 4. Although a pair of openings formed by the recesses 54*a* and 54*b* are shown, it is contemplated that a single elongated opening may be provided.

The parts 10*a* and 10*b* are also provided with internal recesses 56*a* and 58*a*, and 56*b* and 58*b*, respectively, each of which is adapted to receive therein half of one of the fuse contact members 16*a*, 16*b*. In particular, the part 10*a* has the fuse contact member 16*a* disposed therein and when the parts 10*a* and 10*b* are assembled together, the recess 58*a* receives therein half of the fuse contact member 16*b*, which is disposed within the recess 56*b* of the part 10*b*. The parts 10*a* and 10*b* are further formed with internal projections 60*a* and 62*a*, and 60*b* and 62*b*, respectively, between each of the opennings 42, 44 and the fuse contact recesses 56, 58. The projections 60 and 62 extend away from the sidewalls a sufficient distance to substantially block any direct line between an opening and a fuse contact member on the same side. The purpose of these projections 60, 62 is to eliminate as much as possible any possibility for shock hazard.

The fuse carrying member 30 is formed of two identical parts 30*a* and 30*b* which, like the housing parts 10*a* and 10*b*, are inversely opposedly assembled together. The fuse carrying member 30 includes a fuse containment portion and a handle portion. The fuse containment portion is formed of two substantially semi-cylindrical parts 64*a* and 64*b* which, when the fuse carrying member parts30*a* and 30*b* are assembled together, form a cavity adapted to longitudinally receive the cartridge fuse 32 therein. The fuse carrying member 30 also is formed with a handle portion including resilient parts 66*a* and 66*b*. Each of the handle parts 66*a* and 66*b* includes a slit 68*a* and 68*b*, respectively, which extends from the outward edge 70*a*, 70*b*, approximately halfway thereacross. From the termination points 72*a*, 72*b*, of the slits 68*a*, 68*b*, to the corners 74*a*, 74*b*, of the handle parts 66*a*, 66*b*, generally triangular shaped portions 76*a*, 76*b*, are angled outwardly slightly, in an offset manner, to extend beyond the perimeter of the openings in the housing 10 through which the handle portion extends. Thus, the offset portions 76*a* and 76*b* serve to positionally lock the fuse carrying member 30 when the containment portion thereof is within the fuse contact region 14.

Figure 1:
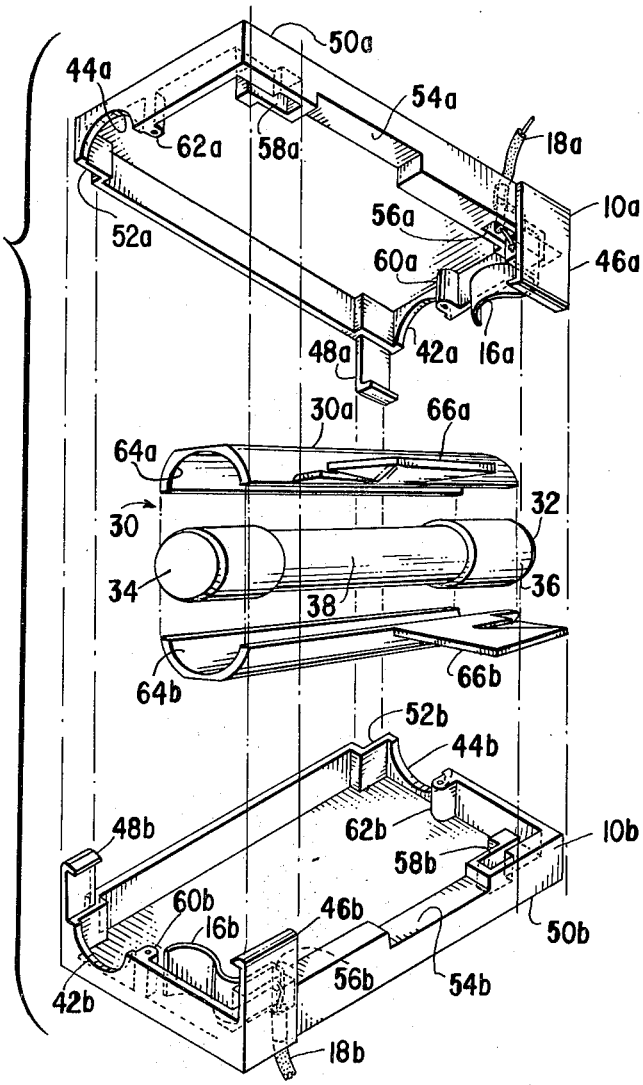
FIG. 1 is a disassembled perspective view of a fuse holder constructed in accordance with the principles of this invention.

The operation of the fuse holder described herein is as follows. Initially, the parts 30*a*, 30*b*, 10*a* and 10*b* are assembled as shown in FIG. 1 in an inversely opposed manner and the latching finger members 46*a*, 48*a*, 46*b* and 48*b* are snapped into place. To insert a cartridge fuse 32 within the fuse holder 10, the handle portion of the fuse carrying member 30 is twisted slightly so that the offset portions 76*a* and 76*b* are moved within the perimeter of the opening in the housing 10 in order that the fuse carrying member may be pushed inwardly of the housing 10 to position the fuse containment portion within the fuse transfer region 12. A cartridge fuse 32 may then be inserted through either of the openings 20, 22 so that the insulative portion 38 is longitudinally received within the fuse containment portion of the fuse carrying member 32. The handle portion of the fuse carrying member 30 is then grasped and pulled outwardly from the housing 10 so that the fuse containment portion is moved from the fuse transfer region 12 to the fuse contact region 14. When the fuse containment portion of the fuse carrying member 30 is within the fuse contact region 14, the conductive fuse retaining members16*a*, 16*b*, bear against the metal end caps 36 and 34, respectively, to thereby make electrical contact therewith. At this time, the offset portions 76*a*, 76*b* move outwardly of the perimeter of the opening in the housing 10 to provide a locking action, keeping the fuse containment portion of the fuse carrying member 30 within the confines of the fuse contact region 14. To remove a fuse from the fuse holder, the handle portion of the fuse carrying member 30 is twisted slightly so that the offset portions 76*a* and 76*b* are moved within the perimeter of the opening in the housing to thereby allow the fuse carrying member 30 to be moved inwardly of the housing 10 to position the fuse containment portion within the fuse transfer region 12. The fuse 32 may then be removed from the housing 10 through either of the openings 20 or 22 in any one of several ways. For example, the fuse holder may be oriented so that the fuse 32 is generally vertical and the fuse holder may be gently shaken to cause the fuse to come out through one of the openings 20 or 22. Alternatively, a narrow elongated object such as, for example, a pencil may be inserted through one of the openings 20 or 22 to push the fuse 32 out through the other of the openings. A further alternative manner of removing the fuse 32 is to insert a replacement fuse through one of the openings 20 or 22 and push the fuse to be removed out through the other of the openings.

It is noted that the act of inserting or removing a fuse does not involve any shock hazard to an operator because the only electrically live contact points are the contact members 16*a*, 16*b*, and these are remote from the openings 20, 22 which are the only locations where an operator handles the fuse. Additionally, the projections 60, 62 provide a further shielding effect.

Accordingly, there has been disclosed an improved fuse holder which eliminates the possibility of a shock hazard while the fuse is being inserted or removed, and is inexpensive to manufacture. It is understood that theabove-described embodiment is merely illustrative of the application of the principles of this invention. Numerous other embodiments may be devised by those skilled in the art without departing from the spirit and scope of this invention, as defined by the appended claims.

I claim

1. A fuse holder for a cartridge type fuse comprising:

a housing having a fuse transfer region and a fuse contact region laterally spaced apart within said housing;

means for providing access between the exterior of said housing and said fuse transfer region, including a first opening formed in said housing through which a cartridge type fuse may pass in an axial direction; and carrier means captured within said housing for moving a fuse between said fuse transfer region and said fuse contact region;

said housing being formed with a second opening and said carrier means including a handle portion extending through said second opening, whereby movement may be imparted to said carrier means from outside said housing.

2. The fuse holder according to claim 1 further including a pair of resilient conductive fuse contact members mounted within said housing in said fuse contact region and adapted to engage the conductive ends of a cartridge type fuse moved into said fuse contact region by said carrier means.

3. The fuse holder according to claim 1 wherein said carrier means further includes a fuse containment portion formed with a cavity adapted to longitudinally receive a cartridge type fuse therein.

4. The fuse holder according to claim 3 further including means for positionally locking said carrier means when said fuse containment portion of said carrier means is within said fuse contact region of said housing.

5. A fuse holder for a cylindrical cartridge type fuse having conductive portions on the ends thereof and an insulative portion intermediate the ends, said fuse holder comprising:

a housing formed with a first opening through which a fuse may pass in an axial direction and a second opening;

a pair of conductive fuse retaining members mounted within said housing in a location remote from said first opening, said fuse retaining members each adapted to engage one of the fuse conductive portions; and a fuse carrying member disposed within said housing, said fuse carrying member including a handle portion extending through said second opening and a fuse containment portion having a cavity adapted to longitudinally receive the insulative portion of a fuse therein, said fuse carrying member being selectively movable within said housing between a first position wherein said fuse containment portion is proximate said first opening in said housing and a second position wherein said fuse containment portion is proximate said fuse retaining members.

6. The fuse holder according to claim 5 wherein said housing is formed of two identical pieces fitted together in an inversely opposed manner.

7. The fuse holder according to claim 5 wherein said handle portion is formed of resilient material and includes an offset portion adapted to extend beyond the perimeter of said second opening when said fuse carrying member is in said second position, thereby to provide a locking action for said fuse carrying member in said second position.

8. The fuse holder according to claim 5 wherein said fuse carrying member is formed of two identical pieces fitted together in an inversely opposed manner.

9. The fuse holder according to claim 5 wherein each of said fuse retaining members includes a conductive spring member adapted to press against the outer end of a fuse when said fuse carrying member is in said second position.

10. The fuse holder according to claim 5 wherein said housing is formed with a pair of first openings through which a fuse may pass in an axial direction, said pair of first openings being one each on opposing sides of said housing in alignment with each other, each of said fuse retaining members being mounted along one of said opposing sides, and said housing being formed with internal projections between each of said first openings and the fuse retaining member along the side corresponding to each first opening, thereby to substantially block any direct line between a first opening and a fuse retaining member on the same side of said housing.

* * * * *